US005140789A

United States Patent [19]

De Gooyer

[11] Patent Number: 5,140,789

[45] Date of Patent: Aug. 25, 1992

[54] UNDERLAY FOR TILE FLOOR OF SHOWER

[76] Inventor: Lonnie C. De Gooyer, 349 E. 5600 South, Murray, Utah 84107

[21] Appl. No.: 418,541

[22] Filed: Oct. 10, 1989

[51] Int. Cl.[5] ..... A47K 3/22

[52] U.S. Cl. ..... 52/71; 52/105; 4/613

[58] Field of Search ..... 52/98, 198, 105, 71, 52/35.34; 4/596, 599, 612, 613, 614, 581, 583, 582

[56] References Cited

U.S. PATENT DOCUMENTS

| | | | |
|---|---|---|---|
| 2,025,814 | 12/1935 | Goss | 4/613 |
| 2,255,893 | 9/1941 | Mullett | 4/613 |
| 3,289,360 | 12/1966 | Gartner | 52/13 |
| 4,014,145 | 3/1977 | Groves | 52/13 |
| 4,503,644 | 3/1985 | Coutu | 52/13 |
| 4,541,132 | 9/1985 | Long | 4/614 |
| 4,719,723 | 1/1988 | Van Wagoner | 52/15 |

OTHER PUBLICATIONS

Sweet's Catalog File by McGraw Hill Information Systems N.Y., N.Y. 1985 7.15 Ap pp. 1,2,3 and 7.15 Oak pp. 1 and 4.

*Primary Examiner*—John E. Murtagh
*Attorney, Agent, or Firm*—Terry M. Crellin

[57] ABSTRACT

A segmented underlay is disclosed for use in installing a title floor of a shower. The underlay comprises a set of identical planar, rigid members which when laid side-by-side in a circuitous fashion form an underlay having a continuous surface which slopes substantially uniformly from the perimeter of the underlay to the center of the underlay.

21 Claims, 3 Drawing Sheets

UNDERLAY FOR TILE FLOOR OF SHOWER

BACKGROUND OF THE INVENTION

1. Field of the Invention

The present invention relates to an improved underlay for use in installing a tile floor of a shower. In particular, the invention relates to novel, universal pieces of planar material which are readily positioned about the drain of a shower floor and provide the proper slope for the pan of the tile shower installation.

2. State of the Art

Building codes generally specify that a pan be placed on the floor, with mortar and tile being laid over the pan. The purpose of the pan is to direct any water seeping by the tile to the drain rather than into the floor beneath the shower. To accomplish its purpose, the pan must slope to the drain which is generally positioned at the center of the shower floor. The general practice is for the mason to place sand on the floor and to slope the sand from the outer edges of the shower stall toward the drain. The pan is then placed on the sand underlayment. Laying of the sand underlayment is time consuming, and in many installations, especially those done by do-it-yourself masons, the pan gets placed directly on the floor with no slope.

In the prior patent art there are disclosures of shower units in which the base of the unit forming the floor of the shower is prefabricated to set on the support structure such as the sub-floor of the shower stall. These units are made of metal or plastic and of a predetermined sized. The units cannot be reduced in size, and thus there is no flexibility for custom designed and sized shower installations. These units further have integral floors and are not adapted to have tile laid on the floors. Representative examples of such patent art are U.S. Pat. Nos. 1,766,125; 2,437,068; 3,800,335; 3,895,398; and 4,423,528.

A prefabricated floor module which has roughly textured inside surfaces to which tile can be laid is disclosed in U.S. Pat. No. 4,557,004. The unit is integrally formed from plastic materials. It is formed to a definite, preset size and cannot be changed. There is no flexibility for custom designed and sized shower installations. The floor module is cumbersome and awkward to use as well as costly to make and use.

3. Objectives

A principal objective of the present invention is to provide a segmented underlay for use in installing a tile floor of a shower wherein the underlay comprises inexpensive planar members which are laid side-by-side on the sub-floor of the shower stall.

A particular objective of the present invention is to provide such a segmented underlay in which each member used in making the underlay is identical to the other members so as to reduce cost of manufacturing and eliminate the need for stocking multiple sets of members in different sizes and shapes.

An additional objective of the present invention is to provide such a segmented underlay in which each member when laid on the sub-floor will provide an upper surface which slopes toward the drain, and in combination with the other members of the underlay forms a uniform surface upon which the pan of the shower floor is supported.

A further objective of the present invention is to provide such a segmented underlay in which each of the members can be cut using conventional tools to any desired size, and wherein a plurality of markings are applied to the surface of the member to aid in cutting the member to such desired size.

BRIEF DESCRIPTION OF THE INVENTION

The above objectives are achieved in accordance with the present invention by providing a novel, segmented underlay for use in installing a tile floor to a shower. The underlay comprises a set of identical planar, rigid members which when laid side-by-side in a circuitous fashion form an underlay having a continuous surface which slopes substantially uniformly from the perimeter of the underlay to the center of the underlay.

In a preferred embodiment, each member is sized so as to cover about one-fourth of the area of the intended shower floor. When laid, each member abuts two adjacent members in a circuitous fashion so as to form the underlay covering the desired area. The respective edges of the members which form the perimeter of the underlay have maximum thickness, and the thickness of each member decreases substantially uniformly in a radial direction toward a common point coinciding with the center of the underlay. The upper surface of the underlay thus slopes downwardly from the perimeter of the underlay towards the drain of the shower which is located at the center of the underlay.

In use, the workman simply lays the members of the underlay in the desired position on the sub-floor. The shower pan is then laid on the underlay, and because of the sloped surface of the underlay, the shower pan slopes to the center or drain. Tile is then laid in standard fashion on the pan.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which.

DETAILED DESCRIPTION OF THE ILLUSTRATED EMBODIMENTS

Figure 1:
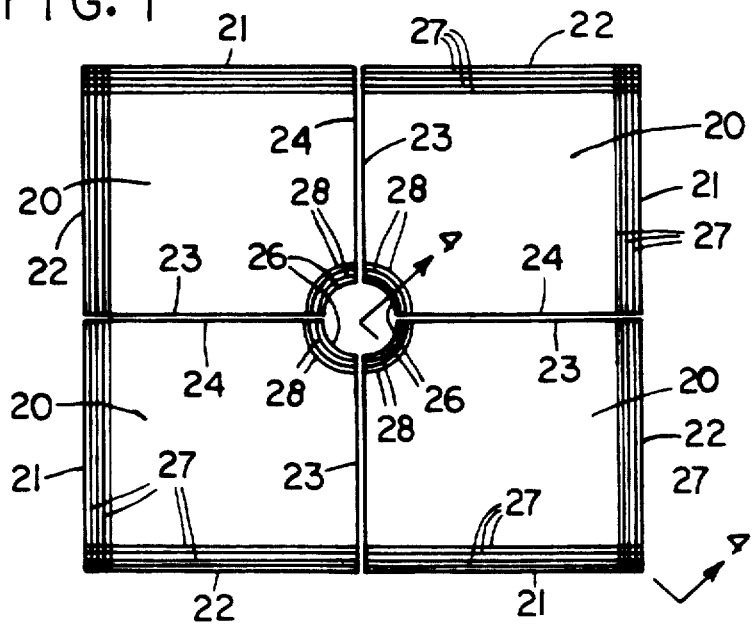
FIG. 1 is a top plan view of one embodiment of a segmented underlay in accordance with the present invention for use in installing a tile floor of a shower.
Figure 4:
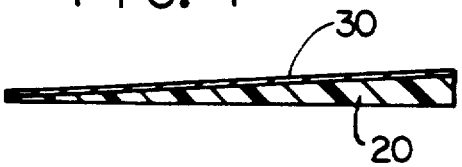
FIG. 4 is a cross section through one of the members of the underlay of FIG. 1 taken along the line 4—4 of FIG. 1.
Figure 5:
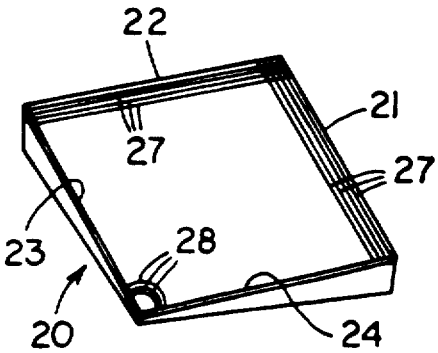
FIG. 5 is a pictorial view of a single member of the underlay of FIG. 1 showing a slight variant in which the fourth corner is not cut out but is provided with markings for use in cutting a desired cut out therein.

One preferred embodiment of a segmented underlay in accordance with the present invention is shown in FIGS. 1, 4 and 5. The underlay comprises four pieces 20 of planar, rigid material. Each of the pieces 20 has first, second, third and fourth substantially straight sides 21, 22, 23 and 24, respectively, with each side having first and second ends.

The first and second sides 21 and 22 of each of the pieces 20 intersect each other at respective first ends thereof to form one corner of each piece 20, with the first and second sides 21 and 22 being oriented at substantially right angles with respect to each other. The first ends of the third and fourth sides 23 and 24 of each of the pieces 20 intersect the respective second ends of the first and second sides 21 and 22 to form second and third corners of each piece 20. The third and fourth sides 23 and 24 of each piece 20 are oriented at substantially right angles to respective first and second sides 21 and 22, with the third and fourth sides of the piece 20 extending toward a common point, which in the variant shown in FIG. 5 forms the fourth corner of the piece 20. In the variant shown in FIGS. 1 and 4, the third and fourth sides 23 and 24 of each piece 20 of rigid, planar material are shorter than the first and second sides 21 and 22, such that the second ends of the third and fourth sides 23 and 24 do not intersect but instead are connected by an arcuate corner edge 26 which has the form of a circular arc whose center is at the common point.

Each of the piece 20 has a substantially uniform thickness along the first and second sides 21 and 22 thereof, with the thickness of the piece 20 decreasing substantially uniformly, as best shown in FIG. 4, along any radial direction from the first and second sides 21 and 22 toward the common point. As illustrated in FIG. 1, the four pieces 20 are laid side-by-side in a circuitous fashion to cover a substantially rectangular area covering the sub-floor of the intended shower. The pieces 20 are arranged with their respective third and fourth sides 23 and 24 abutting each other, with the arcuate corner cut out being positioned at the intended drain for the shower. The pieces 20 when so arranged provide a sloping surface which slants substantially uniformly toward the drain along any radial direction through the drain.

As illustrated, it is advantageous to provide a plurality of substantially straight, spaced apart, parallel markings 27 extending in two sets along a face of the piece of rigid, planar material, with the first set being located adjacent to and parallel with the first side 21 of the piece 20 and with the second set being located adjacent to and parallel with the second side 22 of the piece 20. These markings provide guide lines for the workman to cut the pieces 20 into the correct size corresponding to the size of the sub-floor which is to be covered.

In the variant shown in FIG. 5, the second ends of the third and fourth sides 23 and 24 of the piece 20 of rigid, planar material intersect at the common point, with at least one arcuate marking 28 extending from the third side 23 to the fourth side 24. The arcuate marking or markings 28 are preferably in the form of circular arcs whose centers are at the common point. The marking or markings 28 provide guide lines for the workman to cut an opening corresponding to the drain of the shower floor. Such arcuate marking or markings 28 can also be provided on the variant shown in FIGS. 1 and 3 to provide guide lines for cutting the opening larger if necessary.

Figure 2:
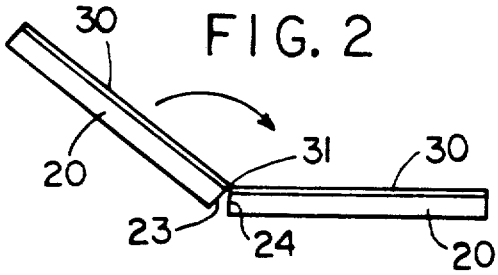
FIG. 2 is a side view of two adjacent members of the underlay of FIG. 1 wherein a hinge means interconnects abutting sides of the two members, and one member is shown partially folded toward the other member.
Figure 3:
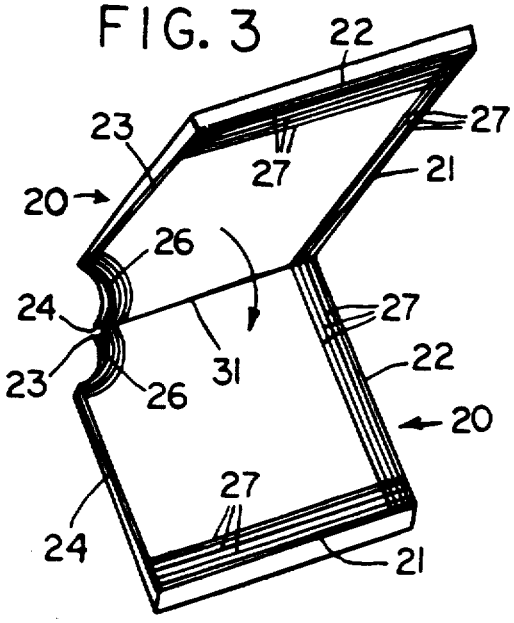
FIG. 3 is a pictorial view of the partially folded members of FIG. 2.

A folding underlay can be made from two of the pieces 20 of rigid, planar material of the embodiment shown in FIG. 1. The folding underlay is shown in FIGS. 2 and 3. Two adjacent pieces 20 are attached together along abutting, respective third and fourth sides 23 and 24 thereof by a pivoting attachment means which allows the two pieces 20 to be folded back upon each other so that one piece can be superposed upon the other. The pivoting attachment means comprises a hinge member attached to mutually respective faces of the two pieces 20 such that the pivot axis of the hinge extends along the abutting sides of the two pieces 20.

The pieces 20 of rigid, planar material are preferably made of foamed polymeric material, and a sheet of corrugated cardboard 30 is attached to one of the respective faces of the pieces 20. The pivoting attachment means can be formed by the corrugated cardboard which extends over two adjacent pieces 20, with a pivot axis 31 being formed by a straight bend line in the sheet of cardboard 30 adjacent to the abutting sides of the two pieces 20.

Figure 6:
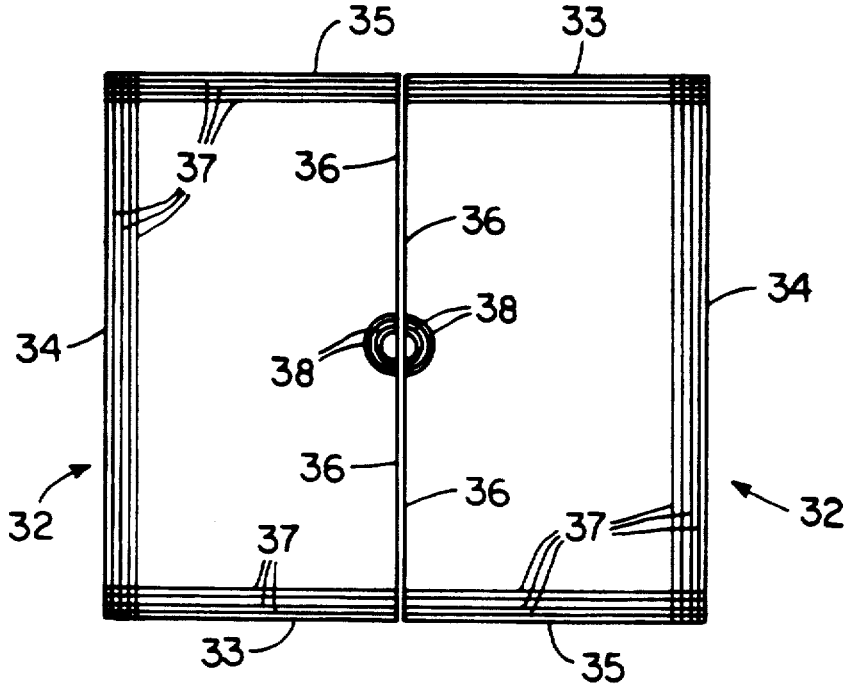
FIG. 6 is a top plan view of a second embodiment of a segmented underlay in accordance with the present invention.

An embodiment of a two piece, segmented underlay which is a variant of the four piece segmented underlay of FIG. 1 can be formed by combining two adjacent pieces of the embodiment shown in FIG. 1 into a single unit in which each of the two units are identical to each other. Such a two piece, segmented underlay is shown in FIG. 6. Each piece 32 of planar, rigid material has first, second, third and fourth substantially straight sides 33, 34, 35 and 36, with each side having first and second ends.

The first and second sides 33 and 34 of each piece 32 intersect each other at respective first ends thereof to form one corner of the piece 32, and the first and second sides 33 and 34 are oriented at substantially right angles with respect to each other. The first ends of the third and fourth sides 35 and 36 of the piece 32 intersect the respective second ends of the first and second sides 33 and 34 to form second and third corners of the piece 32, with the third and fourth sides 35 and 36 being oriented at substantially right angles to the respective first and second sides 33 and 34. The second ends of the third and fourth sides 35 and 36 intersect to form a fourth corner of the piece 32. The fourth side 36 is parallel to the second side 34, and the third side 35 is parallel to the first side 33. The piece 32 has a substantially uniform thickness along the first, second and third sides 33, 34 and 35 thereof, with the thickness of the piece 32 decreasing substantially uniformly along any radial direction toward the midpoint of the fourth side 36.

As with the underlay pieces described previously, a plurality of substantially straight, spaced apart, parallel markings 37 extend in three sets along a face of each piece 32 of rigid, planar material as guides for cutting the piece 32 to desired size. The first set of each piece 32 is located adjacent to and parallel with the first side 33 of the piece 32. The second set of each piece 32 is located adjacent to and parallel with the second side 34 of the piece 32, and the third set of each piece 32 is located adjacent to and parallel with the third side 35 of the piece 32. An arcuate marking 35 can also be provided on the face of each piece 32 of rigid, planar material, with the arcuate marking 35 being in the form of one or more circular arcs whose centers are the midpoint of the fourth side 36. In place of or in addition to the markings 38, an arcuate cutout can be provided in the fourth side 36 of the piece 32 of rigid, planar material, with the cutout being formed so that its center coincides with the midpoint of the fourth side 36.

Figure 7:
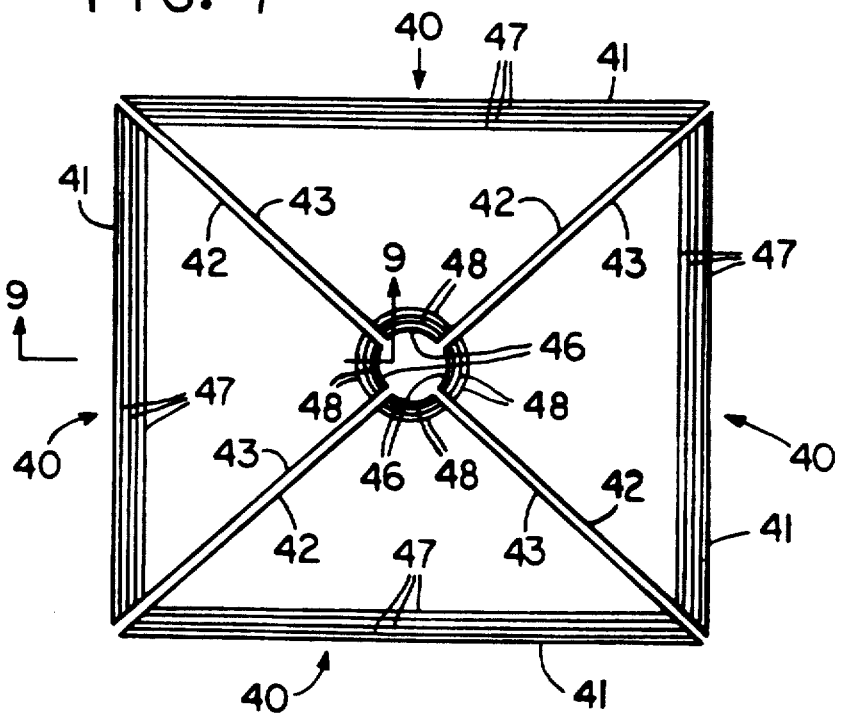
FIG. 7 is a top plan view of a third embodiment of a segmented underlay in accordance with the present invention.
Figure 9:
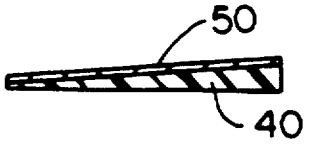
FIG. 9 is a cross section through one of the members of the underlay of FIG. 7 taken along line 9—9 of FIG. 7.
Figure 10:
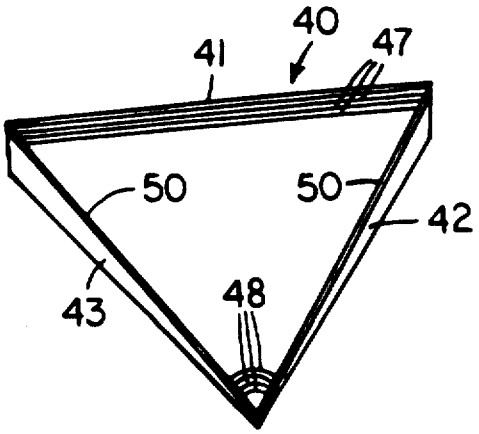
FIG. 10 is a pictorial view of a single member of the underlay of FIG. 7 showing a slight variant in which the third corner is not cut out but is provided with markings for use in cutting a desired cut out therein.

Another preferred embodiment of an underlay in accordance with the present invention is shown in FIGS. 7, 9 and 10. This embodiment comprises four pieces 40 of planar, rigid material. Each of the pieces 40 has first, second and third substantially straight sides 41, 42 and 43, respectively, with each side having first and second ends.

The first and second sides 41 and 42 of the piece 40 intersect each other at respective first ends thereof to form one corner of the piece 40. The first end of the third side 43 of the piece 40 intersects the second end of the first side 41 to form a second corner of the piece 40, with the second and third sides 42 and 43 being oriented so as to extend toward a common point, which in the variant shown in FIG. 10 forms the third corner of piece 40. In the variant shown in FIG. 7, the second and third sides 42 and 43 of the piece 40 of rigid, planar material do not intersect but instead are connected by an arcuate corner edge 46 which has the form of a circular arc whose center is at the common point.

Each of the pieces 40 has a substantially uniform thickness along the first side 41 thereof, with the thickness of the piece 40 decreasing substantially uniformly, as best shown in FIG. 9, along any radial direction from the first side 41 toward the common point. As illustrated in FIG. 7, the four pieces 40 are laid side-by-side in a circuitous fashion to cover a substantially rectangular area covering the sub-floor of the intended shower. The pieces 40 are arranged with their respective second and third sides 42 and 43 abutting each other, with the arcuate corner cut out being positioned at the intended drain for the shower. The pieces 40 when so arranged provide a sloping surface which slants substantially uniformly toward the drain along any radial direction through the drain.

As illustrated, it is advantageous to provide a plurality of substantially straight, spaced apart, parallel markings 47 extending along a face of the piece 40 of rigid, planar material, with the markings 47 being located adjacent to and parallel with the first side 41 of the piece 40. These markings 47 provide guide lines for the workman to cut the pieces 40 into the correct size for the sub-floor which is to be covered.

In the variant shown in FIG. 10, the second ends of the second and third sides 42 and 43 of the piece 40 of rigid, planar material intersect at the common point, with at least one arcuate marking 48 extending from the second side 42 to the third side 43. The arcuate marking or markings 48 are preferably in the form of circular arcs whose centers are at the common point. The marking or markings 48 provide guide lines for the workman to cut an opening corresponding to the drain of the shower floor. Such arcuate marking or markings 48 can also be provided on the variant shown in FIGS. 7 and 9 to provide guide lines for cutting the opening larger if necessary.

Figure 8:
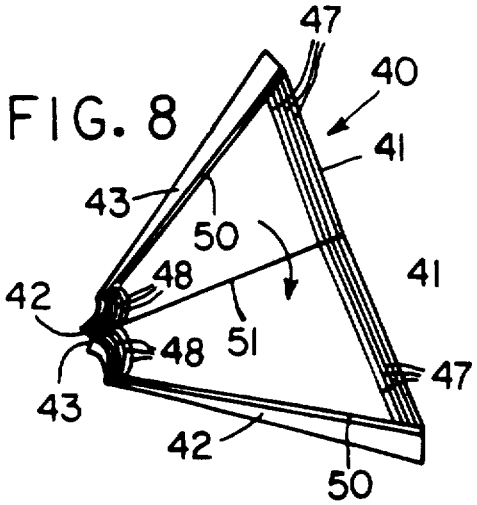
FIG. 8 is a pictorial view of two members of the underlay of FIG. 7 wherein a hinge member interconnects abutting sides of the two members, and one member is shown partially folded toward the other member.

A folding underlay can be made from two of the pieces 40 of rigid, planar material of the embodiment shown in FIG. 7. The folding underlay is shown in FIG. 8 wherein two adjacent pieces 40 are attached together along abutting, respective second and third sides 42 and 43 thereof by a pivoting attachment means which allows the two pieces to be folded back upon each other so that one piece can be superposed upon the other. The pivoting attachment means comprises a hinge member attached to mutually respective faces of the two pieces 40 such that the pivot axis of the hinge extends along the abutting sides of the two pieces 40.

The two pieces 40 of rigid, planar material are preferably made of foamed polymeric material, and a sheet of corrugated cardboard 50 is attached to one of the faces of the pieces 40. The pivoting attachment means can be formed by the corrugated cardboard which extends over two adjacent pieces 40, with a pivot axis 51 being formed by a straight bend line in the sheet of cardboard 50 adjacent to the abutting sides of the two pieces 40.

Figure 11:
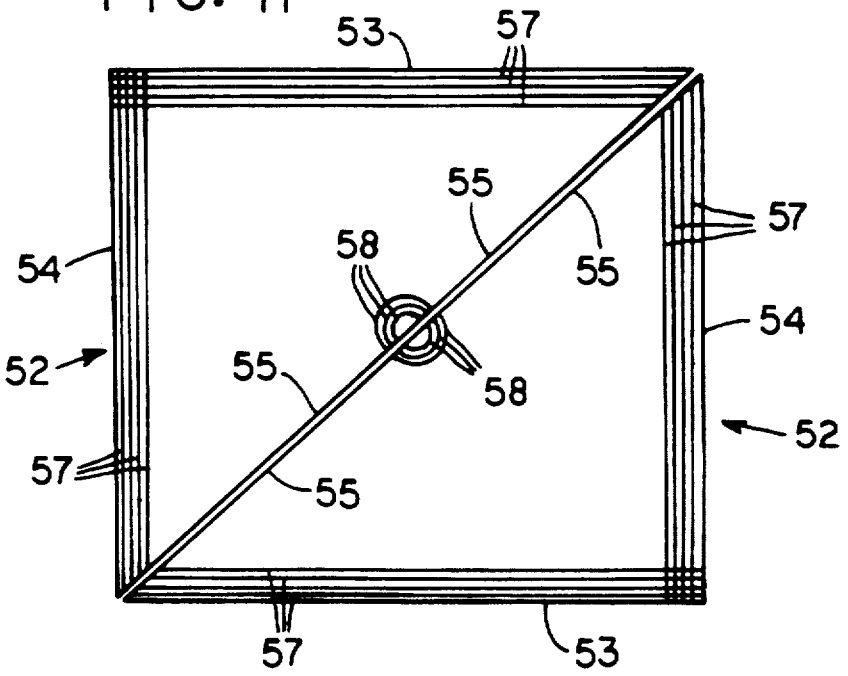
FIG. 11 is a top plan view of a fourth embodiment of a segmented underlay in accordance with the present invention.

An embodiment of a two piece, segmented underlay which is a variant of the four piece segmented underlay of FIG. 7 can be formed by combining two adjacent pieces into a single unit in which each of the two units are identical to each other. Such a two piece, segmented underlay is shown in FIG. 11. Each piece 52 of planar, rigid material has first, second and third substantially straight sides 53, 54 and 55, with each side having first and second ends.

The first and second sides 53 and 54 of each piece 52 intersect each other at respective first ends thereof to form ore corner of the piece 52, and the first and second sides 53 and 54 are oriented at substantially right angles with respect to each other. The opposite ends of the third side 55 of the piece 52 intersect the respective second ends of the first and second sides 53 and 54 to form second and third corners of the piece 52. The piece 52 has a substantially uniform thickness along the first and second sides 53 and 54 thereof, with the thickness of the piece 52 decreasing substantially uniformly along any radial direction toward the midpoint of the third side 55.

As with the underlay pieces described previously, a plurality of substantially straight, spaced apart, parallel markings 57 extend in two sets along a face of each piece 52 of rigid, planar material as guides for cutting the pieces 52 to desired size, with the first set of each piece 52 being located adjacent to and parallel with the first side 53 of the piece 52, and with the second set of each piece 52 being located adjacent to and parallel with the second side 54 of the piece 52. An arcuate marking 58 can also be provided on the face of each piece 52 of rigid, planar material, with the arcuate marking 58 being in the form of one or more circular arcs whose centers are the midpoint of the third side 55. In place of or in addition to the markings 58, an arcuate cutout can be provided in the third side 55 of the piece 52 of rigid, planar material, with the cutout being formed so that its center coincides with the midpoint of the third side 55.

Although preferred embodiments of the underlay of the present invention have been illustrated and described, it is to be understood that the present disclosure is made by way of example and that various other embodiments are possible without departing from the subject matter coming within the scope of the following claims, which subject matter is regarded as the invention.

I claim:

1. An underlay used in installing a tile floor of a shower, said underlay comprising:

a piece of planar, rigid material;

said piece of material has first, second, third and fourth substantially straight sides;

each side has first and second ends;

said first and second sides of said piece intersect each other at respective first ends thereof to form one corner of said piece, with said first and second sides being oriented at substantially right angles with respect to each other;

said first ends of said third and fourth sides of said piece intersect the respective second ends of said first and second sides to form second and third corners of said piece;

said third and fourth sides are oriented at substantially right angles to respective first and second sides, with said third and fourth sides of said piece extending toward a common point; and said piece has a substantially uniform thickness along the first and second sides thereof, with the thickness of said piece decreasing substantially uniformly along any radial direction toward said common point.

2. An underlay in accordance with claim 1, wherein a plurality of cutting guide means in the form of substantially straight, spaced apart, parallel markings extend in two sets along a face of said piece of rigid, planar material, with the first set being located adjacent to and parallel with the first side of said piece and with the second set being located adjacent to and parallel with the second side of said piece.

3. An underlay in accordance with claim 1, wherein the second ends of said third and fourth sides of said piece of rigid, planar material intersect at said common point, and a cutting guide means in the form of an arcuate marking extends from said third side to said fourth side, with said arcuate marking being a circular arc whose center is at said common point.

4. An underlay in accordance with claim 1, wherein said third and fourth sides of said piece of rigid, planar material are shorter than said first and second sides, such that the second ends of said third and fourth sides do not intersect but instead are connected by an arcuate corner edge which has the form of a circular arc whose center is at said common point.

5. A folding underlay comprising two of said pieces of rigid, planar material in accordance with claim 1, with said two pieces being attached together along abutting, respective third and fourth sides thereof by a pivoting attachment means which allows the two pieces to be folded back upon each other so that one piece can be superposed upon the other.

6. A folding underlay in accordance with claim 5, wherein the attachment means comprises a hinge member attached to mutually respective faces of said two pieces such that the pivot axis of said hinge extends along the abutting sides of said two pieces.

7. A folding underlay used in installing a tile floor of a shower, said underlay comprising:

two pieces of planar, rigid material;

each piece of material has first, second, third and fourth substantially straight sides;

each side has first and second ends;

said first and second sides of said piece intersect each other at respective first ends thereof to form one corner of said piece, with said first and second sides being oriented at substantially right angles with respect to each other;

said first ends of said third and fourth sides of each said piece intersect the respective second ends of said first and second sides to form second and third corners of each said piece;

said third and fourth sides are oriented at substantially right angles to respective first and second sides, with said third and fourth sides of each said piece extending toward a common point; and each said piece has a substantially uniform thickness along the first and second sides thereof, with the thickness of each said piece decreasing substantially uniformly along any radial direction toward said common point; and said two pieces being attached together along abutting, respective third and fourth sides thereof by a pivoting attachment means which allows the two pieces to be folded back upon each other so that one piece can be superposed upon the other, wherein said two pieces of rigid, planar material are made of foamed polymeric material and said attachment means comprises a sheet of corrugated cardboard attached to the respective faces of said two pieces, with the pivot axis being formed by a straight bend line in the sheet of cardboard adjacent to the abutting sides of said two pieces.

8. An underlay used in installing a tile floor of a shower, said underlay comprising:

a piece of planar, rigid material;

said piece of material has first, second, third and fourth substantially straight sides;

each side has first and second ends;

said first and second sides of said piece intersect each other at respective first ends thereof to form one corner of said piece, with said first and second sides being oriented at substantially right angles with respect to each other;

said first ends of said third and fourth sides of said piece intersect the respective second ends of said first and second sides to form second and third corners of said piece;

said third and fourth sides are oriented at substantially right angles to respective first and second sides, with said second ends of said third and fourth sides of said piece intersecting to form a fourth corner of said piece, wherein the fourth side is parallel to the second side and the third side is parallel to the first side; and said piece has a substantially uniform thickness along the first, second and third sides thereof, with the thickness of said piece decreasing substantially uniformly along any radial direction toward the midpoint of said fourth side.

9. An underlay in accordance with claim 8, wherein a cutting guide means in the form of a plurality of substantially straight, spaced apart, parallel markings extend in three sets along a face of said piece of rigid, planar material, with the first set being located adjacent to and parallel with the first side of said piece, with the second set being located adjacent to and parallel with the second side of said piece, and with the third set being located adjacent to and parallel with the third side of said piece.

10. An underlay in accordance with claim 8, wherein a cutting guide in the form of an arcuate marking is provided on the face of said piece of rigid, planar material, with the arcuate marking being a circular arc whose center is the midpoint of said fourth side.

11. An underlay in accordance with claim 8, wherein an arcuate cutout is provided in said fourth side of said piece of rigid, planar material, said cutout being formed so that its center coincides with the midpoint of said fourth side.

12. A folding underlay used in installing a tile floor of a shower, said underlay comprising:

two pieces of planar, rigid material;

each said piece of material has first, second and third substantially straight sides;

each side has first and second ends;

said first and second sides of each said piece intersect each other at respective first ends thereof to form one corner of each said piece;

said first end of said third side of each said piece intersect the second end of said first side to form a second corner of each said piece;

said second and third sides are oriented so as to extend toward a common point;

each said piece has a substantially uniform thickness along the first side thereof, with the thickness of each said piece decreasing substantially uniformly along any radial direction toward said common point; and said two pieces are attached together along abutting, respective second and third sides thereof by a pivoting attachment means which allows the two pieces to be folded back upon each other so that one piece can be superposed upon the other.

13. An underlay in accordance with claim 12, wherein a plurality of substantially straight, spaced apart, parallel markings extend along a face of each said piece of rigid, planar material, with the markings being located adjacent to and parallel with the first each of said piece.

14. An underlay in accordance with claim 12, wherein the second ends of said second and third sides of each piece of rigid, planar material intersect at said common point, and an arcuate marking extends from said second side to said third side of each piece, with said arcuate marking being in the form of a circular arc whose center is at said common point.

15. An underlay in accordance with claim 12, wherein each said second and third sides of said piece of rigid, planar material do not intersect but instead are connected by an arcuate corner edge which has the form of a circular arc whose center is at said common point.

16. An underlay in accordance with claim 12, wherein the attachment means comprises a hinge member attached to mutually respective faces of said two pieces such that the pivot axis of said hinge extends along the abutting sides of said two pieces.

17. An underlay in accordance with claim 12, wherein said two pieces of rigid, planar material are made of foamed polymeric material and said attachment means comprises a sheet of corrugated cardboard attached to the respective faces of said two pieces, with the pivot axis being formed by a straight bend line in the sheet of cardboard adjacent to the abutting sides of said two pieces.

18. An underlay used in installing a tile floor of a shower, said underlay comprising:

a piece of planar, rigid material;

said piece of material has first, second and third substantially straight sides;

each side has first and second ends;

said first and second sides of said piece intersect each other at respective first ends thereof to form one corner of said piece, with said first and second sides being oriented at substantially right angles with respect to each other;

the opposite ends of said third side of said piece intersect the respective second ends of said first and second sides to form second and third corners of said piece; and said piece has a substantially uniform thickness along the first and second sides thereof, with the thickness of said piece decreasing substantially uniformly along any radial direction toward the midpoint of said third side.

19. An underlay in accordance with claim 18, wherein a cutting guide in the form of a plurality of substantially straight, spaced apart, parallel markings extend in two sets along a face of said piece of rigid, planar material, with the first set being located adjacent to and parallel with the first side of said piece 6 with the second set being located adjacent to and parallel with the second side of said piece.

20. An underlay in accordance with claim 18, wherein a cutting guide in the form of an arcuate marking is provided on the face of said piece of rigid, planar material, with the arcuate marking being a circular arc whose center is the midpoint of said third side.

21. An underlay in accordance with claim 18, wherein an arcuate cutout is provided in said third side of said piece of rigid, planar material, said cutout being formed so that its center coincides with the midpoint of said third side.

* * * * *